US008698651B2

(12) United States Patent
Nishimura et al.

(10) Patent No.: US 8,698,651 B2
(45) Date of Patent: Apr. 15, 2014

(54) TRAFFIC SIGNAL CONTROL SYSTEM, TRAFFIC SIGNAL CONTROL APPARATUS, AND TRAFFIC SIGNAL CONTROL METHOD

(75) Inventors: Shigeki Nishimura, Osaka (JP); Katsuyuki Suzuki, Osaka (JP); Masafumi Kobayashi, Osaka (JP); Hiroshi Matsumoto, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 169 days.

(21) Appl. No.: 13/383,445

(22) PCT Filed: Dec. 21, 2010

(86) PCT No.: PCT/JP2010/072961

§ 371 (c)(1),
(2), (4) Date: Jan. 11, 2012

(87) PCT Pub. No.: WO2011/114596

PCT Pub. Date: Sep. 22, 2011

(65) Prior Publication Data

US 2012/0112928 A1 May 10, 2012

(30) Foreign Application Priority Data

Mar. 17, 2010 (JP) ..... 2010-060911

(51) Int. Cl.
*G08G 1/07* (2006.01)

(52) U.S. Cl.
USPC ..... 340/909; 340/815.45; 340/916

(58) Field of Classification Search
USPC ..... 340/909, 901, 905, 907, 931, 815.45, 340/815.65, 908.1, 916, 932, 815.42, 340/815.53, 815.47
See application file for complete search history.

(56) References Cited

U.S. PATENT DOCUMENTS

| | | | | |
|---|---|---|---|---|
| 6,466,260 | B1 | 10/2002 | Hatae et al. | |
| 7,006,011 | B1 * | 2/2006 | Colby | 340/907 |
| 7,808,402 | B1 * | 10/2010 | Colby | 340/907 |
| 2005/0187708 | A1 * | 8/2005 | Joe et al. | 701/210 |

FOREIGN PATENT DOCUMENTS

| | | | |
|---|---|---|---|
| CN | 101281685 | A | 10/2008 |
| CN | 101593431 | A | 12/2009 |
| JP | 49-11498 | A | 1/1974 |
| JP | 51-2400 | A | 1/1976 |

(Continued)

OTHER PUBLICATIONS

International Search Report for Application No. PCT/JP2010/072961, Feb. 8, 2011, Sumitomo Electric Ind Ltd.
Notification of the First Office Action for Application No. 201080031910.6, dated Sep. 5, 2013.

(Continued)

*Primary Examiner* — Daniel Previl
(74) *Attorney, Agent, or Firm* — RatnerPrestia

(57) ABSTRACT

Provided is a traffic signal control system that can operate in a flexible and sophisticated manner by, after selecting a pattern of a traffic signal control parameter corresponding to the current time using a first pattern switching table that is used in a time-controlled pattern selection scheme, selecting again a pattern using an additional second pattern switching table, where a call condition for selecting a set pattern is set in the second pattern switching table, and by selecting the pattern set in the second pattern switching table in place of the pattern selected in the first pattern switching table if a calculated travel time matches the call condition.

7 Claims, 9 Drawing Sheets

(56) References Cited

FOREIGN PATENT DOCUMENTS

| | | | |
|---|---|---|---|
| JP | 01-147699 | A | 6/1989 |
| JP | 2001-093082 | A | 4/2001 |
| JP | 2005-182219 | A | 7/2005 |
| JP | 2008-129613 | A | 6/2008 |
| JP | 2009-252066 | A | 10/2009 |

OTHER PUBLICATIONS

Peng Lin, et al., "A study on multi-speed cellular automata model of traffic flow of Main-road with Two-lane under the traffic light control," ACTA Physica Sinica, vol. 53, No. 9, Sep. 2004, pp. 2899-2904 (with English abstract).

Song Yiqing, et al., "Design and Realization of Self-Adaptive Traffic Light Control System," Computer Measurement & Control, vol. 16, No. 4, Apr. 2008, pp. 497-499 (with English abstract).

* cited by examiner

FIG. 4

31 bytes (fixed length)

| D7 D6 D5 D4 D3 D2 D1 D0 |
|---|
| Control command |
| Stair-holding stair number |
| Sensitivity allowed |
| Sensitivity prohibited direction |
| Command identification code |
| Read pattern number |
| Cycle length (second) |
| Split 1 reference value (second) |
| Split 1 + changing value (second) |
| Split 1 - changing value (second) |
| ~ |
| Split 6 reference value (second) |
| Split 6 + changing value (second) |
| Split 6 - changing value (second) |
| Offset operation type |
| Offset following prohibition |
| Offset reference time (hour) |
| Offset reference time (minute) |
| Offset reference time (second) |
| Offset value (second) |

FIG. 7

| Pattern number | Cycle length | Split (Road R1 : R2) | Offset |
|---|---|---|---|
| 1 | 60 seconds | 5 : 5 | 0 seconds |
| 2 | 90 seconds | 6 : 4 | +6 seconds |
| 3 | 120 seconds | 6 : 4 | +6 seconds |
| 4 | 90 seconds | 5 : 5 | 0 seconds |
| 5 | 120 seconds | 4 : 6 | -6 seconds |
| 6 | 90 seconds | 4 : 6 | -6 seconds |
| 7 | 120 seconds | 5 : 5 | 0 seconds |

FIG. 8A

| Switching time | 0:00 | 6:00 | 7:00 | 9:00 | 17:00 | 19:00 | 22:00 |
|---|---|---|---|---|---|---|---|
| Pattern | 1 | 2 | 3 | 4 | 5 | 6 | 1 |

FIG. 8B

| Start time | 0:00 | 6:00 | 7:00 | 9:00 | 17:00 | 19:00 | 22:00 |
|---|---|---|---|---|---|---|---|
| End time | 6:00 | 7:00 | 9:00 | 17:00 | 19:00 | 22:00 | 0:00 |
| Pattern | 1 | 2 | 3 | 4 | 5 | 6 | 1 |

| Start time | 6:30 | 9:00 | 11:00 | 15:00 | 16:30 |
|---|---|---|---|---|---|
| End time | 7:00 | 10:00 | 15:00 | 16:30 | 17:00 |
| Call condition | T1≧300 seconds | T1≧300 seconds | T1≧300 seconds and T3≧300 seconds | T1≧300 seconds and T3≧300 seconds | T3≧300 seconds |
| Call pattern | 3 | 3 | 7 | 7 | 6 |
| Execution time | Continued | 15 minutes | 15 minutes | 15 minutes | Continued |

FIG. 11

| Data | Meaning of data |
|---|---|
| * * | Latitude/longitude information at S1 |
| 10 : 24 : 30 | Passage time (hour: minute: second) at S1 |
| * * | Latitude/longitude information at S2 |
| 10 : 25 : 12 | Passage time (hour: minute: second) at S2 |
| * * | Latitude/longitude information at S3 |
| 10 : 25 : 56 | Passage time (hour: minute: second) at S3 |
| * * | Latitude/longitude information at S4 |
| 10 : 26 : 31 | Passage time (hour: minute: second) at S4 |
| * * | Latitude/longitude information at S5 |
| 10 : 27 : 02 | Passage time (hour: minute: second) at S5 |
| * * | Latitude/longitude information at S6 |
| 10 : 27 : 47 | Passage time (hour: minute: second) at S6 |
| * * | Latitude/longitude information at S7 |
| 10 : 28 : 21 | Passage time (hour: minute: second) at S7 |
| * * | Latitude/longitude information at S8 |
| 10 : 29 : 04 | Passage time (hour: minute: second) at S8 |
| * * | Latitude/longitude information at S9 |
| 10 : 29 : 44 | Passage time (hour: minute: second) at S9 |

TRAFFIC SIGNAL CONTROL SYSTEM, TRAFFIC SIGNAL CONTROL APPARATUS, AND TRAFFIC SIGNAL CONTROL METHOD

This application is a U.S. national phase application of PCT international application PCT/JP2010/072961.

TECHNICAL FIELD

The present invention relates to a traffic signal control system that improves the sophistication of a pattern-selection traffic signal control scheme based on time of day, using travel time information.

BACKGROUND ART

Conventionally, a traffic signal control method (time-controlled pattern selection scheme) has been known in which a plurality of signal control parameters are stored for each time zone and the stored signal control parameters are selected in accordance with the time of day to perform traffic signal control. In this method, a traffic demand is obtained in advance for each time zone before the start of operation, the demands are formed into patterns by time of day, and signal control parameters suitable for each demand pattern are stored.

A traffic signal control method (pattern selection scheme based on the travel time) has also been proposed (see PTL 1) in which traffic conditions are obtained on the basis of a travel time acquired from a vehicle detector or from probe information or the like and thereafter stored signal control parameters are selected in accordance with the pattern of the obtained traffic conditions to perform traffic signal control. The term "probe information" is called floating car data (FCD) generally.

The above pattern-selection traffic signal control methods can be more easily introduced than a scheme for sequentially calculating signal control parameters in accordance with the traffic volume or congestion length, and only operate with one of a plurality of stored patterns. Therefore, the above traffic signal control methods have an advantage in that there is no concern of the above traffic signal control methods being out of expectation, unlike the case of sequential calculation.

CITATION LIST

Patent Literature

PTL 1: Japanese Unexamined Patent Application Publication No. 2009-252066

SUMMARY OF INVENTION

Technical Problem

Among the above pattern selection schemes, the pattern selection scheme based on the travel time may cause signal control parameters that are not suitable for the actual traffic conditions to be selected on the basis of a wrong travel time obtained by, for example, a vehicle detector that has malfunctioned or on the basis of an uncertain travel time obtained from a small number of pieces of probe information. The scheme of selecting a pattern on the basis of only the travel time has room for improvement in order to achieve stable system operation.

Additionally, the time-controlled pattern selection scheme has no problem with traffic signal control in a region where previously estimated traffic demands do not substantially change. In a region that shows variation in the time of day when congestion starts, the time of day when the congestion starts to decrease, and the like, however, in some cases, patterns selected in the corresponding time zones may not be appropriate to the actual traffic conditions, and therefore the scheme of selecting a pattern on the basis of only the time of day also has room for improvement.

The present invention has been made in view of the above situation, and an object thereof is to provide a traffic signal control system that properly operates even in a case where obtained traffic information such as a travel time contains errors or uncertainty or in a case where previously estimated traffic demands are likely to change.

Solution to Problem

A traffic signal control system according to a first aspect of the invention includes storing means for storing a first pattern switching table in which a traffic signal control parameter P1(*i*) is set in association with each first time zone B1(*i*) of a first time schedule in which all time zones of a whole day is divided into a plurality of first time zones; selecting means for selecting a traffic signal control parameter corresponding to the current time from the stored first pattern switching table; controlling means for controlling a traffic signal light unit using the selected traffic signal control parameter; and travel time acquiring means for acquiring travel time information about a vehicle within one or a plurality of road sections in the vicinity of the traffic signal light unit. The storing means further stores a second pattern switching table in which a second condition regarding a travel time in a second time zone T2 including only some of all the time zones of the whole day, and a traffic signal control parameter P2 selected when matching the second condition are set in association with each other. The traffic signal control system further includes determining means for determining whether or not an index obtained on the basis of travel time information acquired by the travel time acquiring means matches the second condition. The selecting means is configured to select the traffic signal control parameter P2 set in the second pattern switching table in place of the traffic signal control parameter P1(*i*) if the determining means determines that the index matches the second condition (claim 1).

Here, i denotes an integer of 1 to m, and m denotes the number of time zones specified in the first pattern switching table.

According to the present invention, basically, traffic signal control parameters are selected in accordance with the time of day set in the first pattern switching table. Additionally, it is possible to select different traffic signal control parameters in a specific time zone (second time zone T2) in accordance with an index based on a travel time.

Accordingly, in the specific time zone, it is possible to select traffic signal control parameters that are considered to be more appropriate on the basis of travel time information. Therefore, traffic signal control more adapted to traffic conditions than a simple time-controlled pattern selection scheme can be performed.

In this system, furthermore, basically, a pattern is selected in accordance with the time of day. Therefore, traffic signal control parameters set in advance by skilled traffic administrators can be selected in most time zones, as compared to a scheme for selecting signal control parameters in accordance with only a travel time. If travel time information acquired by a vehicle detector or the like does not conform to the actual traffic conditions, it is possible to perform appropriate operations in most time zones, leading to high robustness of the system.

In this case, an end time of the second time zone T2 can be set as an end time of a first time zone B1(*k*) that is one of the first time zones included in the first time schedule, a start time of the second time zone can be set as a time later than a start time of the first time zone B1(*k*), and thereafter a traffic signal control parameter P2 that is set in association with the second time zone T2 in the second pattern switching table can be set as a traffic signal control parameter P1(*k*+1) that is set in the first pattern switching table in association with a subsequent first time zone B1(*k*+1) that follows the first time zone B1(*k*) (claim 2).

Here, k denotes any of integers 1 to m, and if k=m, the (k+1) is set as (1).

According to this method, if a first pattern switching table is set on the basis of previous expectations that traffic conditions will change at the end time of the first time zone B1(*k*) (that is, the start time of the B1(*k*+1)), it is possible to select the traffic signal control parameter P1(*k*+1) in the B1(*k*+1) ahead of schedule in response to an earlier change in traffic conditions than the previous expectations. Therefore, more flexible operation than a time-controlled pattern selection scheme can be achieved.

Further, a start time of the second time zone T2 can be set as a start time of a first time zone B1(*k*) that is one of the first time zones included in the first time schedule, an end time of the second time zone can be set as a time earlier than an end time of the first time zone B1(*k*), and thereafter a traffic signal control parameter P2 that is set in association with the second time zone T2 in the second pattern switching table can be set as a traffic signal control parameter P1(*k*−1) that is set in the first pattern switching table in association with a preceding first time zone B1(*k*−1) of the first time zone B1(*k*) (claim 3).

Here, k denotes any of integers 1 to m, and if k=1, the (k−1) is set as (m).

According to this method, if a first pattern switching table is set on the basis of previous expectations that traffic conditions will change at the start time of the first time zone B1(*k*) (that is, the end time of the B1(*k*−1)), it is possible to extend the use of the traffic signal control parameter P1(*k*−1) in the B1(*k*−1) without hastily changing the pattern in response to a later change in traffic conditions than the previous expectations. Therefore, more flexible operation than a time-controlled pattern selection scheme can be achieved.

Preferably, determination made by the determining means is performed every predetermined time in the second time zone T2, and, as a result of the determination, if the index does not match the second condition, the selecting means selects a traffic signal control parameter that is set in the first pattern switching table so as to correspond to the time at which the determination is made (claim 4).

Because, for example, some accident leaves one vehicle stranded on the road or because of any other reason, the travel time acquired by the travel time acquiring means may temporarily greatly vary. However, after the exact vehicle moves, it is probable that the normal state returns soon.

Therefore, in the second time zone T2, the calculation of an index based on a travel time is performed a plurality of times at intervals of, for example, 10 minutes or 15 minutes. When traffic conditions temporarily change but are soon returned to those predicted in advance when the first pattern switching table is set, the traffic signal control parameters set in the first pattern switching table can be used again.

In this manner, flexible switching between the first pattern switching table and the second pattern switching table enables traffic signal control more suitable for traffic conditions.

It is desirable that the travel time acquiring means be configured to acquire a travel time on the basis of probe information that is travel locus information transmitted from a vehicle-mounted unit mounted in a plurality of public vehicles that follow a route including a point where the traffic signal light unit is installed, and that the predetermined time be made longer than a time interval during which the plurality of public vehicles pass through the point where the traffic signal light unit is installed (claim 5).

Acquisition of a travel time using probe information obtained from a public vehicle such as a bus driven by a professional driver to repeatedly follow the same route is less affected by the nature of the driver, the proportion of vehicles having vehicle-mounted units mounted therein, or the like than using probe information from unspecified vehicles, thus facilitating accurate understanding of changes in traffic conditions in each time zone.

Therefore, preferably, on the basis of the assumption that a travel time is obtained from probe information from such public vehicles, the predetermined time in the second time zone is made longer than the interval at which probe information can be acquired from a public vehicle, thus allowing an index based on travel time information obtained from new probe information to be used when traffic signal control parameters are selected.

A traffic signal control apparatus (claim 6) including all the means used in the above traffic signal control system, and a traffic signal control method (claim 7) executed in the traffic signal control system are also very useful.

Advantageous Effects of Invention

According to a traffic signal control system of the present invention, therefore, it is possible to perform traffic signal control adapted to traffic conditions while taking advantage of both a time-controlled pattern selection scheme and a pattern selection scheme using a travel time.

BRIEF DESCRIPTION OF DRAWINGS

FIG. 4 is a diagram illustrating a format of signal control command information.

FIG. 7 is a diagram illustrating an example of a traffic signal control parameter table used in traffic signal control.

FIG. 8A is a diagram illustrating an example of a first pattern switching table used in traffic signal control according to the present invention.

FIG. 8B is a diagram illustrating another example of the first pattern switching table used in traffic signal control according to the present invention.

FIG. 11 is a diagram illustrating an example of the data content of probe information created by the vehicle-mounted device 31.

DESCRIPTION OF EMBODIMENTS (First Embodiment)

[Overall Configuration of System]

Figure 1:
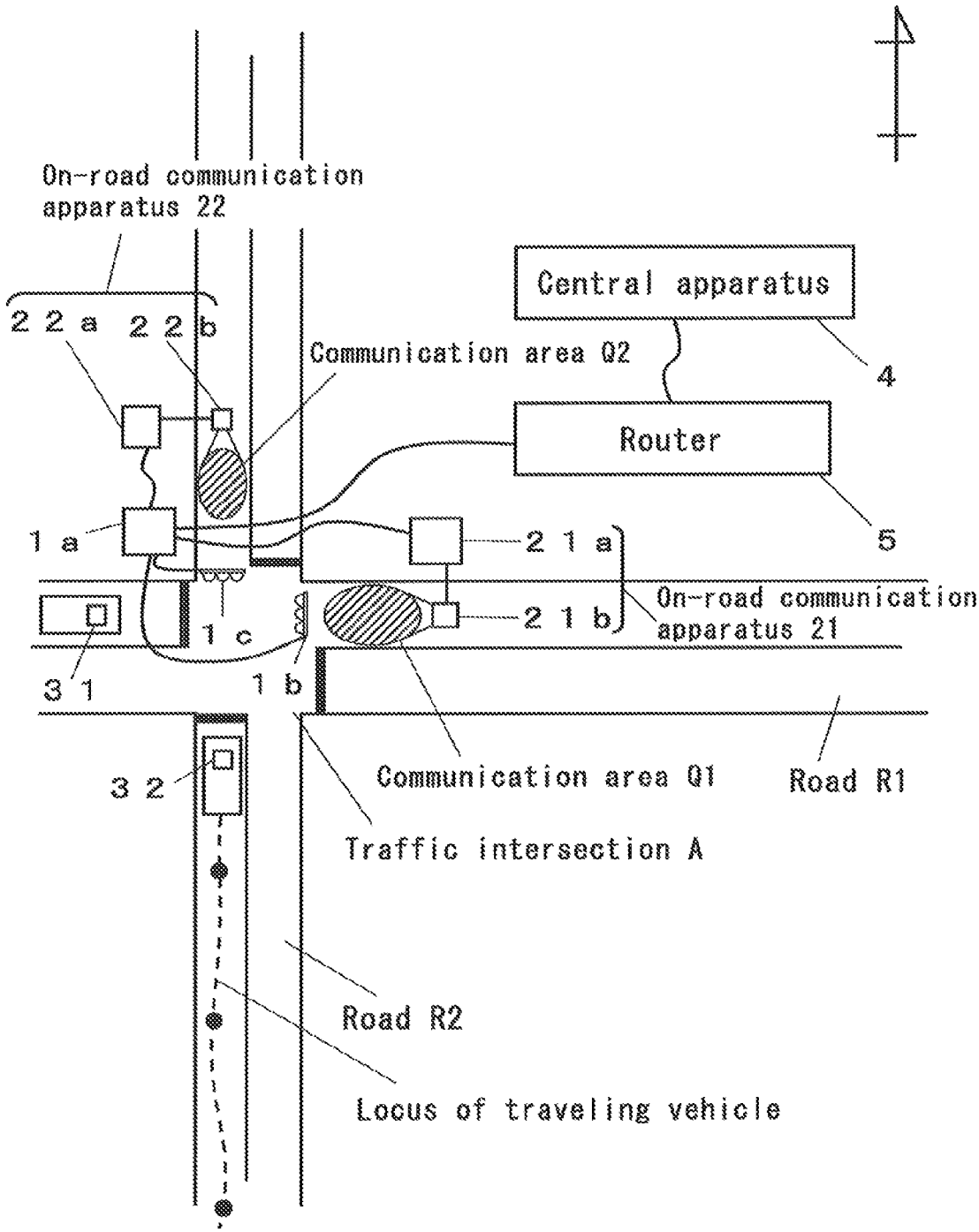
FIG. 1 is a schematic diagram illustrating an overview of a traffic signal control system according to the present invention.

An embodiment of the present invention will be described in detail hereinafter with reference to the accompanying drawings. FIG. 1 is a schematic diagram illustrating an overview of a traffic signal control system according to the present invention. In the drawings of the present invention, the same reference numerals represent the same or like portions.

The traffic signal control system includes a traffic signal 1 (including a traffic signal controller 1*a* and a plurality of vehicular signal light units 1*b*, 1*c*, etc.), an on-road communication apparatus 21 (including a communication antenna unit 21*a* and a communication control device 21*b*) and an on-road communication apparatus 22 (including a communication antenna unit 22*a* and a communication control device 22*b*), such as infrared beacons, vehicle-mounted devices 31 and 32 mounted in vehicles that travel on a road R1 and a road R2, a central apparatus 4, a router 5, and other elements. The central apparatus 4 is an apparatus having a function of giving an instruction regarding control of the traffic signal 1 and a function of performing operations such as generating and transmitting traffic information to be provided for vehicles, and is installed in a traffic control center. The central apparatus 4 may not necessarily be installed in a traffic control center but may be installed on a road.

The central apparatus 4 is connected to a traffic signal installed in each of a plurality of traffic intersections via a communication line such as a telephone line or a communication apparatus such as the router 5. The traffic signal 1 is connected to the on-road communication apparatuses 21 and 22 individually installed on a plurality of roads on which traffic flows in a traffic intersection A for the road R1 and the road R2 via a communication line such as a telephone line.

The traffic signal 1 has a function of controlling a plurality of signal light units. Having the right of way against a vehicle traveling on the road R1 toward the traffic intersection A is indicated by the vehicular signal light unit 1*b*, and having the right of way against a vehicle traveling on the road R2 toward the traffic intersection A is indicated by the vehicular signal light unit 1*c*.

The traffic signal controller 1*a* has a function of receiving a signal control command that is an instruction about traffic information or signal light unit control from the central apparatus 4, and controls the turn-on/off and flashing of each signal light unit such as the signal light unit 1*b* in accordance with an instruction.

If a crosswalk is located at the traffic intersection A, additionally, a pedestrian signal light unit may also be connected to the traffic signal controller 1*a*.

Figure 2:
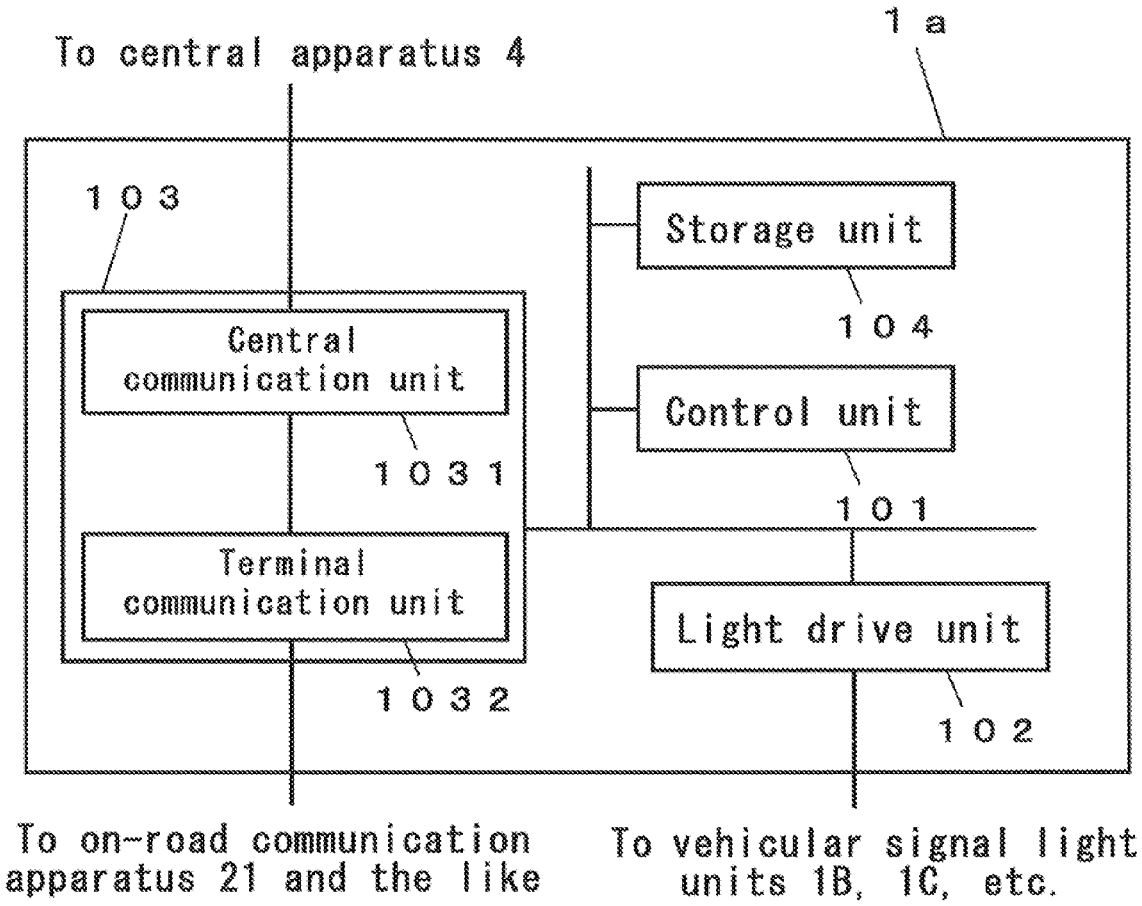
FIG. 2 is a block diagram illustrating an example of the configuration of a traffic signal controller 1*a*.

FIG. 2 is a block diagram illustrating the configuration of the traffic signal controller 1*a*. A control unit 101 includes one or a plurality of microcomputers. A light drive unit 102, a communication unit 103, and a storage unit 104 are connected to the control unit 101 via an internal bus or the like, and the control unit 101 controls the operation of each of the above hardware components.

The light drive unit 102 includes a solid-state relay (not illustrated), and turns on/off an alternating-current voltage (AC 100 V) or a direct-current voltage to be supplied to signal lights of the respective colors respectively corresponding to the green lights, the yellow lights, and the red lights of the plurality of signal light units 1*b*, 1*c*, etc. on the basis of a signal light unit output command input from the control unit 101.

The communication unit 103 includes a central communication unit 1031 for performing communication with the central apparatus 4, and can receive traffic information, signal control commands, and the like from the central apparatus 4. The communication unit 103 further includes a terminal communication unit 1032, and can transmit the received traffic information to the on-road communication apparatus 21 or the like or receive information about a vehicle-mounted device and the like sent from the on-road communication apparatus 21 or the like.

The storage unit 104 stores received traffic information, information about signal control commands or a vehicle-mounted device, information about various constants such as constants indicating the relationships between each step and each phase, etc.

The on-road communication apparatuses 21 and 22 are provided on the roads R1 and R2 which intersect each other, respectively, and are installed so as to be able to communicate with vehicles traveling in the lanes on the side in which traffic flows out from the traffic intersection A. Applicable examples of the on-road communication apparatuses include infrared beacons, radio beacons, and wireless communication apparatuses supporting communication schemes such as DSRC (Dedicated Short Range Communication), WAVE (Wireless Access in Vehicle Environment), and WiMAX (Worldwide interoperability for microwave access), and the on-road communication apparatuses have a function of exchanging various kinds of information with a vehicle-mounted device via wireless communication.

The installation points of the on-road communication apparatuses 21 and 22 are not limited to those in the lanes on the side in which traffic flows out. The on-road communication apparatuses 21 and 22 may be installed in any place as long as they can exchange information with vehicles passing through the traffic intersection A. In road-to-vehicle communication, furthermore, not only on-road communication apparatuses installed near roads but also on-road communication apparatuses installed at distant points and having wide area communication capabilities may be used.

Figure 3:
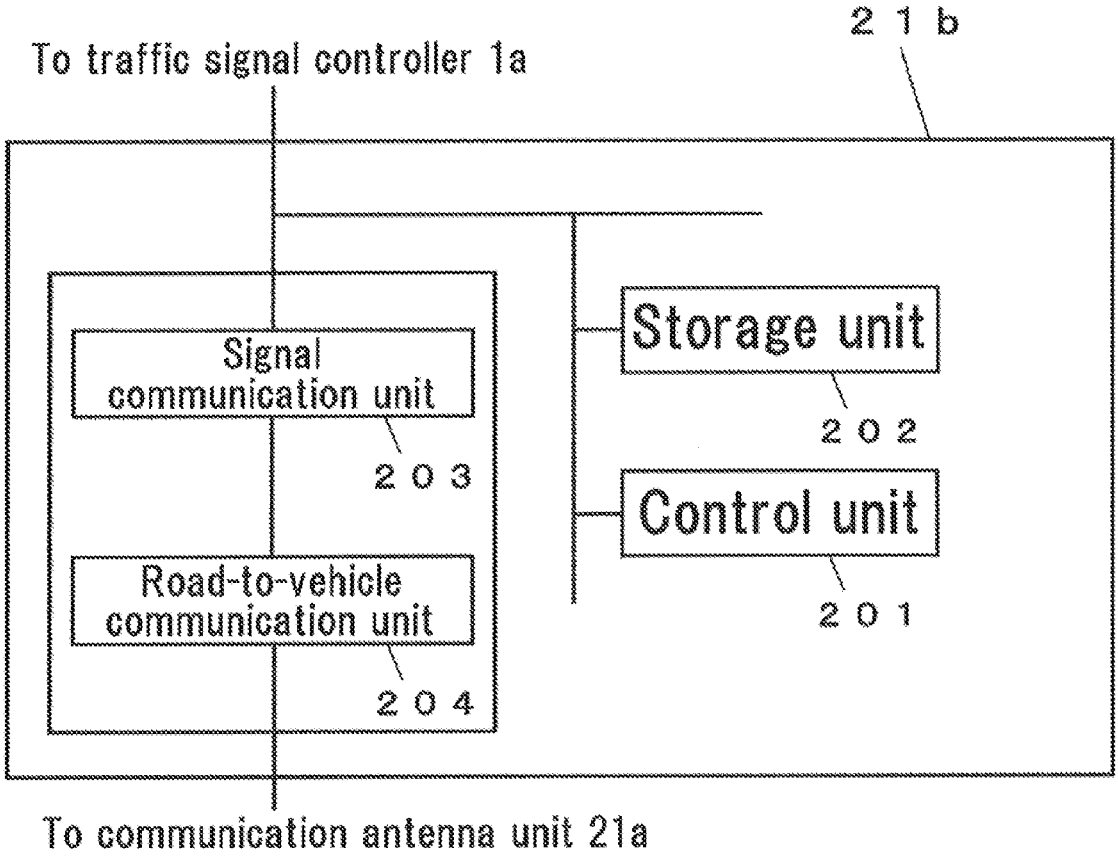
FIG. 3 is a block diagram illustrating an example of the configuration of a communication control device 21*b* of an on-road communication apparatus 21.

FIG. 3 is a block diagram illustrating the configuration of the communication control device 21*b* of the on-road communication apparatus 21. The communication control device 22*b* also has the same configuration and function as the communication control device 21*b*.

A control unit 201 includes one or a plurality of microcomputers, and controls the operation of individual hardware components such as a signal communication unit 203 via an internal bus or the like.

A storage unit 202 stores in advance road shape information regarding the distance from the on-road communication apparatus 21 to the traffic intersection A, the gradient, and so on, information about a region including the traffic intersection A, and the like. The above information may be stored in advance or may be acquired from the central apparatus 4 or the like and stored.

The signal communication unit 203 has a function of receiving traffic information through the traffic signal 1 from the central apparatus 4, and a road-to-vehicle communication unit 204 has a function of transmitting the above information to a vehicle-mounted device via the communication antenna unit 21*a*.

Further, information regarding a vehicle-mounted device, such as uplink information, which has been received by the road-to-vehicle communication unit 204 from the vehicle-mounted device, is transmitted to the traffic signal controller 1*a* or the like by the signal communication unit 203.

The central apparatus 4 transmits traffic information and signal control commands to a plurality of traffic signals at predetermined intervals. FIG. 4 is a diagram illustrating a format of a signal control command. In FIG. 4, split 1 represents the split of aspect 1, split 6 represents the split of aspect 6. The details of this format are described in the written standards published by the Universal Traffic Management Society of Japan (hereinafter, the UTMS association).

The on-road communication apparatuses 21 and 22 may not necessarily be configured to communicate with the central apparatus 4 through the traffic signal controller 1*a*, and can also communicate with the central apparatus 4 using the router 5, a communication line, or the like without intervention of the traffic signal controller 1*a*.

The vehicle traveling on the road R1 (the vehicle traveling from left to right in FIG. 1) has the vehicle-mounted device 31 mounted therein, and the vehicle-mounted device 31 exchanges various kinds of information with the on-road communication apparatus 21 via wireless communication. The vehicle having the vehicle-mounted device 31 mounted therein performs wireless communication with the on-road communication apparatus 21 when passing through a communication area Q1 (a shaded portion on the road R1 in FIG. 1) of the on-road communication apparatus 21, and transmits uplink information including information regarding the vehicle ID (Identification) thereof and receives traffic information.

Also, the vehicle traveling on the road R2 (the vehicle traveling from down to up in FIG. 1) has the vehicle-mounted device 32 mounted therein, and the vehicle-mounted device 32 performs wireless communication with the on-road communication apparatus 22 when passing through a communication area Q2 (a shaded portion on the road R2 in FIG. 1) of the on-road communication apparatus 22 so as to be able to transmit uplink information including information regarding the vehicle ID thereof and to receive traffic information.

The uplink information includes probe information indicating the locus of a traveling vehicle (broken line in FIG. 1), which is created using a method described below.

[Traffic Signal Control Method]

A traffic signal control method according to the present invention will be described hereinafter.

FIG. 7 illustrates a parameter table that stores types of patterns each of which is a combination of a plurality of traffic signal control parameters, in which traffic signal control parameters of a pattern specified in a first pattern switching table that sets which pattern is to be selected in which time zone, as in FIG. 8A, can be used. A scheme of performing traffic signal control based on the time of day using the first pattern switching table is a conventional time-controlled pattern selection scheme.

In the first pattern switching table in FIG. 8A, only times of day when the patterns are switched are set. However, as in FIG. 8B, time zone start times and end times may be set in the top rows of the table so that a pattern can be selected in accordance with the start time and the end time. For example, as in FIG. 8B, pattern 1 may be set as the first pattern P1(1) in the first time zone B1(1), i.e., "0:00 to 6:00", and pattern 2 may be set as the second pattern P1(2) in the second time zone B1(2), i.e., "6:00 to 7:00". That is, any data format that allows pattern selection according to the time of day may be employed.

Here, a time zone determined by the first pattern switching table and a pattern associated therewith are defined as B1(*i*) and P1(*i*), respectively. Here, i denotes an integer of 1 to m, where m denotes the number of time zones specified in the first pattern switching table. In the example in FIG. 8A and FIG. 8B, m=7.

Figures 9, 10:
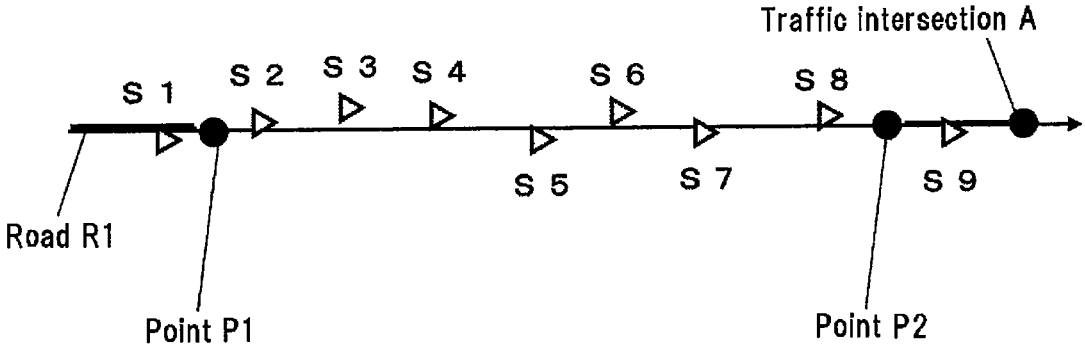
FIG. 9 is a diagram illustrating an example of a second pattern switching table used in traffic signal control according to the present invention.
FIG. 10 is a schematic diagram for explaining probe information created by the vehicle-mounted device 31.

In the present invention, traffic signal control is performed using, in addition to the first pattern switching table, a second pattern switching table as in FIG. 9.

The content will be described in detail hereinafter.

Figure 5:
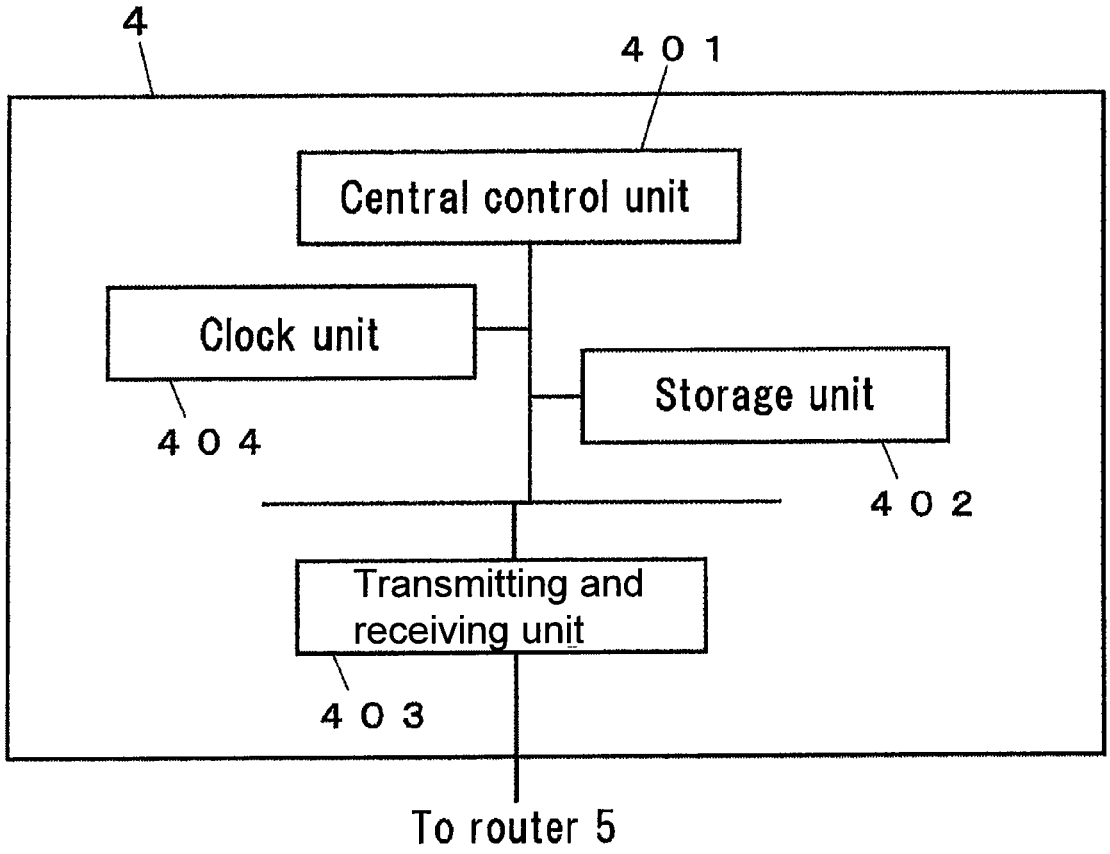
FIG. 5 is a block diagram illustrating an example of the configuration of a central apparatus 4.

FIG. 5 is a diagram illustrating the configuration of the central apparatus 4 that determines parameters for traffic signal control.

In general, the central apparatus 4 includes a computer apparatus having an arithmetic function and a data storage function, such as a workstation or a personal computer.

A central control unit 401 corresponds to a CPU or the like of the computer apparatus, and has a function of executing arithmetic processing of various kinds of data, hardware control, and the like, which will be described hereinafter.

A transmitting and receiving unit 403 has a function of exchanging information with the traffic signal controller 1*a* or the like via the router 5 or the like.

A storage unit 402 stores various kinds of information such as the first pattern switching table described above and traffic information, and has a function of storing input information used for arithmetic operations in the central control unit 401, information regarding arithmetic operation results, information transmitted and received by the transmitting and receiving unit 403, and the like.

The arithmetic processing for determining traffic signal control parameters, which will be described hereinafter, is executed by using the central control unit 401 and the storage unit 402, and is generally implemented as a computer program.

First, the central control unit 401 refers to the current time acquired by a clock unit 404.

Then, the central control unit 401 acquires the number of the pattern corresponding to the current time from the first pattern switching table.

For example, if the current time is 20:00, according to the first pattern switching table in FIG. 8A or FIG. 8B, the current time is included in the time zone B1(6), i.e., "19:00 to 22:00", and pattern 6 has been set as the pattern P1(6) corresponding to this time zone. Therefore, pattern 6 is selected.

Next, a portion of the second pattern switching table corresponding to the current time is referred to. The second pattern switching table is a new table prepared in the present invention to improve the sophistication of the conventional time-controlled pattern selection scheme, using the travel time.

The second pattern switching table in FIG. 9 sets call conditions C2(1) to C2(5), execution times E2(1) to E2(5), and the like corresponding to five time zones B2(1) to B2(5). However, since the time zone corresponding to 20:00 does not exist, the second pattern switching table is not used for the determination of traffic signal control parameters.

Also in the second pattern switching table, like in the first pattern switching table, a time zone determined by the second pattern switching table and a pattern associated therewith are defined as B2(*j*) and P2(*j*), respectively. Here, j denotes an integer of 1 to n, where n denotes the number of time zones specified in the second pattern switching table. In the example in FIG. 9, n=5.

Therefore, if the current time is 20:00, the traffic signal control parameters of pattern 6 set in the first pattern switching table described above are used. Specifically, the following traffic signal control parameters are used: a cycle length of 90 seconds, a split of 4:6 (the green time of 4:6 is assigned to the intersecting roads R1 and R2), and an offset of −6 seconds (the difference between the green signal start time at a traffic intersection, which is an offset reference point, and the green signal start time at the traffic intersection A is −6 seconds).

In this way, traffic signal control parameters are determined by performing the following operations in sequence: first, selecting a pattern in the first pattern switching table and then referring to the second pattern switching table.

The operation at the time of day when a call condition and the like are actually set in the second pattern switching table in FIG. 9 will be described hereinafter.

In the examples in FIGS. 8A and 8B and 9, the traffic signal control parameters of P1(1), i.e., pattern 1, are used at 0:00, which is the start time of the time zone B1(1). After that, traffic signal control is continuously executed using the parameters of pattern 1 until 6:00, which is the end time of the time zone B1(1). When 6:00 is reached, due to the transition to the time zone B1(2) in the first pattern switching table, traffic signal control using another pattern P1(2) corresponding to this time zone, i.e., pattern 2, is started.

After that, the operation continues with pattern 2 as it is until 6:30. When 6:30 is reached, the time zone B2(1) at the left end of the second pattern switching table in FIG. 9 applies. Thus, determination for the call condition C2(1) described in the time zone B2(1) in the second pattern switching table is performed.

The call condition C2(1) described here is a condition that T1 (the travel time on the road R1 in the direction going from left to right) is greater than or equal to 300 seconds. T3 denotes the travel time on the road R1 in the road going from right to left. A method for calculating the travel time T1 and the like will be described below.

This call condition is a conditional expression for determining whether or not the road R1 in the direction going from left to right is congested with traffic, and it is assumed that the travel time during periods of non-congestion is normally about 240 seconds. That is, if the travel time is longer than normal by 60 seconds (25%) or more, it can be determined that the road R1 in the direction going from left to right is congested with traffic.

If the acquired travel time T1 is, for example, 250 seconds, the call condition C2(1) is not satisfied. Therefore, traffic signal control is executed, without selecting pattern 3 written in the second pattern switching table, using the traffic signal control parameters of pattern 2 acquired in the first pattern switching table.

If the acquired travel time T1 is, for example, 350 seconds, in contrast, the call condition C2(1) is satisfied. Therefore, traffic signal control is executed using the traffic signal control parameters of the pattern P2(1) written in the second pattern switching table, i.e., pattern 3, rather than using pattern 2 selected in the first pattern switching table.

Since the execution time E2(1) is set "continued" in the second pattern switching table, the traffic signal control parameters of pattern 3 are used for 30 minutes until the end time, i.e., 7:00.

This traffic signal control method has the following technical advantages:

As a result of the analysis of traffic conditions in the traffic intersection A, skilled traffic signal control experts have concluded that the traffic volume gradually increases from around 6:00 and the road R1 in the direction of going from left to right starts to become congested with traffic after 7:00.

In the first pattern switching table, therefore, pattern 2, which is selected after 6:00 is reached, has set therein a cycle length (90 seconds) that is longer than that in the preceding pattern 1 by 30 seconds. Regarding the split, furthermore, the green time that accounts for 60 percent is assigned to the road R1 side (the green time that accounts for 40 percent is assigned to the intersecting road R2 side).

After 7:00 is reached, the traffic volume further increases and congestion starts. Thus, in order to handle the increased traffic volume, pattern 3 is selected to assign a longer cycle length (120 seconds) than that of pattern 2.

In the conventional time-controlled pattern selection scheme using only the first pattern switching table, if there is variation in time when the traffic conditions change, the execution of traffic signal control using a pattern obtained in the first pattern switching table can cause a possibility that the traffic volume that can be handled in the traffic intersection A before and after the time of execution of traffic signal control may be smaller than the normal performance (the traffic volume that can be handled per unit time).

For example, if the time when the road R1 actually starts to become congested is earlier than the predicted time when the road R1 will start to become congested, i.e., 7:00, it is desirable that the cycle length be set to be about 120 seconds in order to handle the traffic volume; however, the cycle length is still kept at 90 seconds. Thus, the number of vehicles that can pass through the traffic intersection A during one cycle is limited, and there is a possibility that some of the vehicles in a waiting queue are not allowed to pass through the traffic intersection A for a single green signal interval. Such vehicles are still forced to be in the waiting queue until the next green cycle for the road R1. The remaining vehicles accumulate, and the number of vehicles in the waiting queue along the road R1 greatly increases over a period of several cycles, thus causing severe traffic congestion.

The above situation can be avoided by switching to traffic signal control parameters in accordance with congestion slightly before 7:00 as well as taking the changes in traffic conditions into account.

That is, as in the present invention, a second pattern switching table is prepared in addition to the first pattern switching table, and in the second pattern switching table, the traffic signal control parameters of pattern 3, which is scheduled to be used after 7:00, can be used earlier than normal between 6:30, which is 30 minutes earlier than 7:00, and 7:00, in accordance with the travel time. This makes it possible to perform flexible control even if the traffic conditions change earlier than usual.

That is, with the use of the second pattern switching table, in a time zone from slightly before the end time of a certain time zone B1($k$) to the end time, P1($k$+1), which is scheduled to be used in the next time zone B1($k$+1), can be used ahead of schedule instead of the pattern P1($k$) that is scheduled to be used in the time zone B1($k$) ($k$=1 to m).

If similar processing is to be performed around the end time of the time zone B1($m$), the next time zone will be the time zone B1(1) of the next day. Therefore, P1(1) corresponding to the time zone B1(1) may be used as the P1($k$+1) ahead of schedule.

Here, a description has been given of a method in which a pattern set in the first pattern switching table is used ahead of schedule in order to address the case where the traffic conditions change earlier than expected, such as between about 6:00 and 7:00. In the second time zone (time zone starting at 9:00 and ending at 10:00) in the second pattern switching table, however, an operation for addressing later changes in traffic conditions than expected may be performed.

According to the first pattern switching table, pattern 3 is set between 7:00 and 9:00 (time zone B1(3)), and is set to be switched to pattern 4 after 9:00 is reached (time zone B1(4)).

The reason is as follows. It is expected that the traffic congestion that has started around 7:00 will come to an end after 9:00 with the result of a decrease in traffic volume and will settle to such an extent that the traffic volume can be handled with a shorter cycle length (90 seconds) than that of pattern 3.

If the state of congestion does not change even after 9:00, it is desirable that the traffic signal control parameters of pattern 3 be continuously used. However, according to the conventional time-controlled pattern selection scheme using only the first pattern switching table, the cycle length is reduced to 90 seconds, and there is a possibility that the state of traffic congestion will become severer.

However, with the use of the second pattern switching table of the present invention, in a situation where the travel time T1 still exceeds 300 seconds (for example, 330 seconds) even in the time zone B2(2) (time zone starting at 9:00 and ending at 10:00), the traffic signal control parameters (a cycle length of 120 seconds) of pattern 3 (P2(2)) can be continuously used.

In the time zone B2(2) (time zone starting at 9:00 and ending at 10:00), the execution time E2(2) is set to be 15 minutes. Thus, for example, if it is determined that pattern 3 is still used because T1 is greater than or equal to 300 seconds at 9:00, pattern 3 is continuously used at least until 9:15 in order to avoid frequent changes in patterns for a short period of time.

After 9:15 is reached, if T1 is less than 300 seconds, the traffic signal control parameters (a cycle length of 90 seconds) of pattern 4, which has been set in the first pattern switching table, are used.

That is, with the use of the second pattern switching table, in a time zone between the end time of a certain time zone B1($k$–1) (the start time of the time zone B1($k$)) and a time before the end time of the time zone B1($k$), P1($k$–1), which has been used in the preceding time zone B1($k$–1), can be used continuously in place of the pattern P1($k$) that would have been scheduled to be used at the start time of the time zone B1($k$) ($k$=1 to m).

If similar processing is to be performed around the start time of the time zone B1(1), the preceding time zone will be the time zone B1($m$) of the previous day. Therefore, P1($m$) corresponding to the preceding time zone, i.e., the time zone B1($m$), may be used continuously as the P1($k$–1).

In this way, even if traffic conditions change earlier or later than expected, the use of the second pattern switching table in addition to the first pattern switching table makes it possible to use traffic signal control parameters ahead of schedule more than usual or continuously.

While an example in which time zones in the second pattern switching table are set before and after a time when a pattern is switched in the first pattern switching table has been described here, like the third time zone B2(3) (time zone starting at 11:00 and ending at 15:00) in the second pattern switching table, a time zone may be set regardless of the start time and end time of the switching time zone B1(4) (9:00 and 17:00) in the first pattern switching table.

In the time zone B2(3) (time zone starting at 11:00 and ending at 15:00), the case of traffic congestion caused by a temporary increase in traffic volume in a daytime time zone is assumed. If the travel times T1 and T3 of two-way traffic on the road R1 are greater than or equal to 300 seconds, pattern 7 (P2(3)) is used so that the cycle length can be set to 120 seconds, which is 30 seconds longer.

[Method for Acquiring Travel Time T1 and the Like]

A method for acquiring the travel time T1 and the like, which are necessary input conditions to carry out the present invention, will be described hereinafter.

Several methods for acquiring a travel time may be available. One typical method is to install a number plate reader at each of the start point and end point of the desired road section for which a travel time is to be acquired and to set the difference between the times when the same vehicle number is read at the two points as the travel time. Another method is to set an on-road communication apparatus that performs dedicated short range communications, such as an infrared beacon, at each of the start point and end point of the desired road section for which a travel time is to be acquired and to set the difference between the times when uplink information including the same vehicle ID is received at the two points as the travel time.

Figure 6:
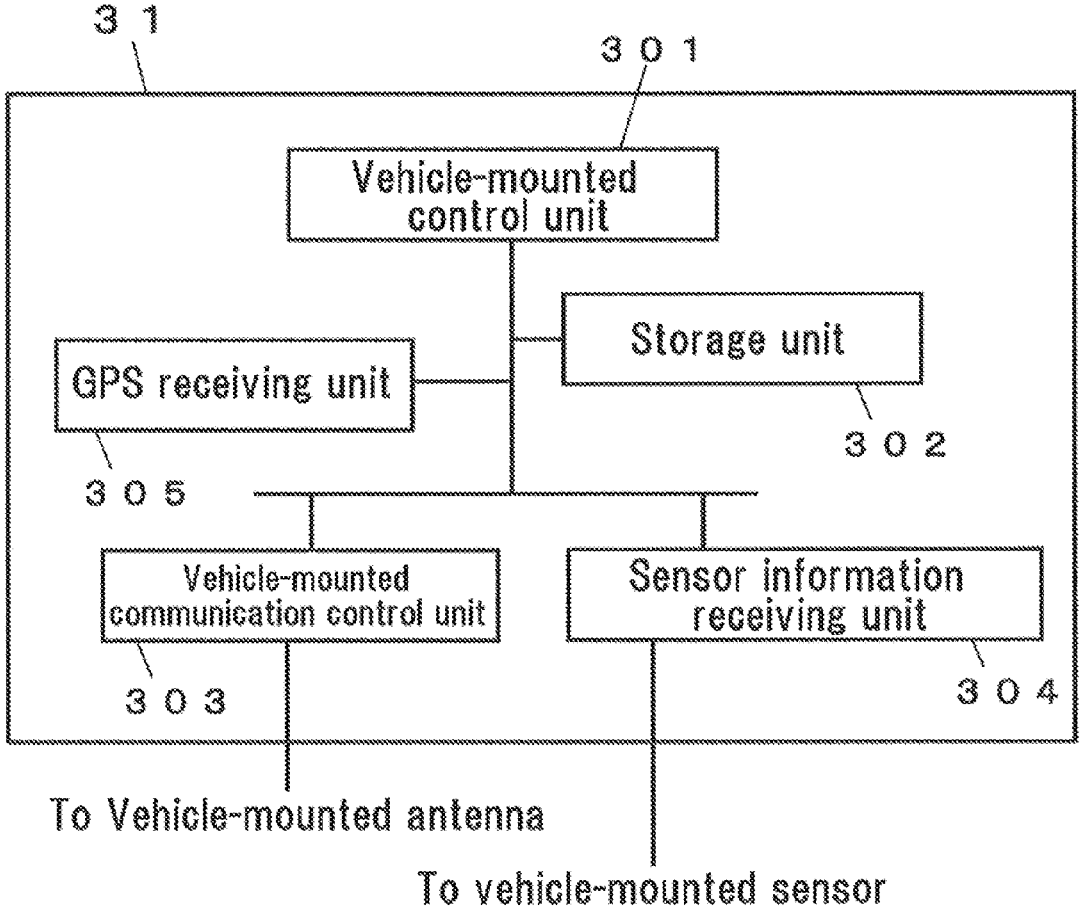
FIG. 6 is a block diagram illustrating an example of the configuration of a vehicle-mounted device 31 mounted in a vehicle.

In the present invention, any of the methods described above may be used; however, preferably, a travel time is calculated using probe information collected from vehicles having mounted therein the vehicle-mounted devices 31, 32, etc. having a function of uplinking probe information. The vehicle-mounted devices 31 and 32 will be described in detail hereinafter with reference to FIG. 6.

[Configuration of Vehicle-Mounted Devices 31 and 32]

A vehicle-mounted control unit 301 includes one or a plurality of microcomputers. The vehicle-mounted control unit 301 controls the operation of each of hardware components connected via an internal bus or the like, such as a vehicle-mounted communication control unit 303.

A storage unit 302 stores a vehicle ID in advance. The vehicle-mounted control unit 301 creates uplink information including the vehicle ID. The vehicle-mounted communication control unit 303 transmits the created uplink information to the on-road communication apparatus 21.

The current position of the vehicle and the current time can be obtained using a GPS receiving unit 305. The vehicle-mounted control unit 301 has a function of creating probe information in which sample points at which vehicle passage positions and passage times are associated with each other are discretely recorded.

The timing of recording the sample points may be based on, for example, a method of recording sample points at certain intervals (every 10 seconds or every 100 meters travel), or may be based on a method of recording sample points when the traveling state of a vehicle changes, such as turn right, turn left, stop, and go.

Some vehicles may be provided with various sensors. Information from such sensors may be acquired by a sensor information receiving unit 304, and may be included in probe information. Examples of the sensors include a millimeter-wave radar that measures the following distance from a preceding or following vehicle, a sensor that detects the number of passengers in a vehicle, and a sensor that acquires weather conditions such as temperature and humidity.

[Travel Time Calculation Method Performed in Central Apparatus 4]

The probe information created in the above manner and the uplink information including the vehicle ID are transmitted to the on-road communication apparatus 21 or the like via a vehicle-mounted antenna connected to the vehicle-mounted communication control unit 303.

As in FIG. 1, the installation of the on-road communication apparatuses 21 and 22 in the vicinity of the traffic intersection A makes it possible to collect probe information from a plurality of vehicles passing through the traffic intersection A.

The content of a process in which the central control unit 401 calculates a travel time when the probe information that the central apparatus 4 receives via the on-road communication apparatus 21 or the like is as in the schematic diagram of FIG. 10 and when the data content of the probe information is as illustrated in FIG. 11 will be described (in FIG. 11, the illustration of latitude and longitude data is omitted).

In FIG. 10, sample points S1 to S9 recorded by the vehicle-mounted device 31 are schematically illustrated. Sample points off the road R1 are also recorded because the latitude and longitude information acquired by the GPS receiving unit 305 can contain an error up to about several tens of meters.

It is assumed here that the travel time between points P1 and P2 that are upstream from the traffic intersection A on the road R1 (on the left side of the traffic intersection A in FIG. 1) is computed as T1. When the probe information included in the uplink information transmitted from the vehicle-mounted device 31 to the on-road communication apparatus 21 after the vehicle-mounted device 31 has passed through the traffic intersection A is as in FIG. 10 or FIG. 11, the passage times at the points P1 and P2 are estimated on the basis of the probe information and thereafter the difference between the passage times is computed as the travel time T1.

According to FIG. 11, the passage time at S1, which is in the vicinity of the point P1, is 10:24:30 and the passage time at S2 is 10:25:12. The passage time at the point P1 between them can therefore be estimated to be the middle of these two times, i.e., 10:24:51.

Likewise, for the point P2, the passage time at S8 is 10:29:04 and the passage time at S9 is 10:29:44. The passage time at the point P2 between them can therefore be estimated to be the middle of these two times, i.e., 10:29:24.

Accordingly, the difference between the passage times at the points P1 and P2 can be calculated to be 4 minutes 33 seconds, and 273 seconds is calculated as the travel time T1.

As described above, the central control unit 401 can acquire the travel time T1 from a single piece of probe information, and can also acquire the travel time T1 from a plurality of pieces of probe information acquired per unit time (for example, for five minutes). For example, if 10 pieces of probe information have been successfully acquired per unit time, the average value may be set as the travel time T1 during that time. Alternatively, the maximum value and the minimum value may be excluded and the average value may be calculated in order to remove the data of a vehicle that travels in a manner extremely different from other multiple vehicles (such as a vehicle that parks for a certain period of time and therefore travels, spending much time, between the points P1 and P2), and the resulting value may be set as the travel time T1.

It is possible to determine a call condition C2 in the second pattern switching table on the basis of the travel time T1 acquired in the above manner. It is also possible to calculate T3 using probe information obtained from a vehicle traveling from right to left on the road R1 in a similar manner.

[Method Using Probe Information from Public Vehicle]

When the travel time T1 is to be calculated on the basis of probe information, the probe information to be used to calculate the travel time may be limited to probe information obtained from a public vehicle that regularly travels on the road R1.

Vehicle IDs assigned to public vehicles are numbers that are different from vehicle IDs assigned to general vehicles, and a public vehicle can be identified by the vehicle ID.

Therefore, first, the central control unit 401 determines, based on the vehicle ID included in obtained uplink information, whether or not the vehicle that has transmitted the uplink information is a public vehicle. If the vehicle is not a public vehicle, the probe information is not used for the calculation of the travel time T1 and the like, whereas if the vehicle is a public vehicle, the probe information is used for the calculation of the travel time T1 and the like.

Then, the travel time T1 and the like are calculated on the basis of only probe information obtained from a public vehicle by using a method similar to that described above.

The advantages of probe information being limited to that from a public vehicle are as follows.

Probe information obtained from a general vehicle is subject to variation in the number of pieces of data or accuracy, which is obtained, in accordance with the proportion of vehicles having mounted therein vehicle-mounted devices capable of creating probe information. Particularly, in a region with a low proportion, a large difference in the accuracy of travel time obtained may occur between a time zone in which the number of pieces of probe information obtained is large and a time zone in which the number of pieces of probe information obtained is small.

Further, some general vehicles may follow routes different from commonly used routes, such as taking a side trip to a store or parking off a road to look at a map, or a certain variation or more in the travel time obtained may be expected depending on the driver's habits and the like during the driving operation. Therefore, the travel time obtained from such a vehicle can be different from that based on the actual traffic flow.

In this regard, limiting probe information to that from public vehicles allows probe information that correctly reflects the actual traffic flow to be more probably obtained because it can be expected that a professional driver who repeatedly drives on the same path will stably travel without sudden acceleration or deceleration or the like. Even if the absolute number of pieces of probe information obtained is small, more accurate calculation of a travel time can be expected.

There is another merit that if every public vehicle has mounted therein a vehicle-mounted device capable of creating probe information, a number of pieces of probe information corresponding to the number of public vehicles that are scheduled to pass per unit time can be obtained with certainty. That is, for example, if a plurality of routes of fixed route buses that pass along the road R1 exist and the acquisition of probe information from two or more fixed route buses within 10 minutes is scheduled from the timetable of the fixed route buses, it is possible to calculate a travel time every 10 minutes and then determine a call condition C2 in the second pattern switching table.

Further, the execution time (for example, 15 minutes) that is the interval at which the determination is performed is set longer than the interval (for example, 10 minutes) at which a travel time is calculated, thus allowing a newer travel time than that at the time of the previous determination to be always obtained next time the call condition C2 is determined (at the time after the execution time has elapsed) after a pattern is selected. Therefore, it is possible to select a pattern on the basis of an always new travel time, which is very advantageous.

In the foregoing embodiment, for example, the traffic signal controller 1*a* and the on-road communication apparatuses 21 and 22 may communicate with each other via wireless communication or wired communication, or one or a plurality of information relay apparatuses may be used, each of which relays the exchange of information may be provided between the above apparatuses.

In the above-described embodiment, furthermore, the traffic signal controller la and the on-road communication apparatus 21 and the like are configured to be accommodated in separate housings. However, this is not to be construed in a limiting sense, and the traffic signal controller 1*a* and the on-road communication apparatus 21 and the like may be configured to be accommodated in a single housing. In this case, information may be exchanged between the traffic signal controller 1*a* and the on-road communication apparatus 21 and the like using any of wired transmission, wireless transmission, an internal bus, and the like.

In this exemplary embodiment, the central control unit 401 of the central apparatus 4 determines a traffic signal control method. However, the traffic signal controller 1*a* may determine a traffic signal control method.

That is, the traffic signal controller 1*a* may hold the first and second pattern switching tables, and the traffic signal controller 1*a* may receive uplink information through the on-road communication apparatus 21 or 22, and determine which pattern to select by using the travel time T1 and the like calculated from the uplink information. The above processes may also be executed by any other on-road apparatus (for example, the information relay apparatus or apparatuses described above and the like).

The embodiment disclosed herein is merely illustrative in any sense, and should not be construed in a limiting sense. The scope of the present invention is given by the claims rather than by the foregoing description, and is intended to encompass any changes falling within the meaning and range equivalent to that of the claims.

Industrial Applicability

The above traffic signal control system takes advantage of both a time-controlled pattern selection scheme and a pattern selection scheme using a travel time, and can be suitable for use in traffic signal control adapted to traffic conditions where obtained traffic information such as a travel time contains errors or uncertainty or where previously estimated traffic demands are likely to change.

Reference Signs List

1*a* traffic signal controller
1*b*, 1*c* signal light unit
101 control unit
102 light drive unit
103 communication unit
1031 central communication unit
1032 terminal communication unit
104 storage unit
21, 22 on-road communication apparatus
21*a*, 22*a* communication antenna unit
21*b*, 22*b* communication control device
201 control unit
202 storage unit
203 signal communication unit
204 road-to-vehicle communication unit
31, 32 vehicle-mounted device
301 vehicle-mounted control unit
302 storage unit
303 vehicle-mounted communication control unit
304 sensor information receiving unit
305 GPS receiving unit
4 central apparatus
5 router
A traffic intersection
Q1, Q2 communication area
R1, R2 road
P1, P2 point
S1 to S9 sample point of probe information

The invention claimed is:

1. A traffic signal control system comprising:

storing means for storing a first pattern switching table in which a traffic signal control parameter P1(*i*) is set in association with each first time zone B1(*i*) of a first time schedule in which all time zones of a whole day is divided into a plurality of first time zones, where i denotes an integer of 1 to m and m denotes the number of time zones specified in the first pattern switching table;

selecting means for selecting a traffic signal control parameter corresponding current time from the stored first pattern switching table;

controlling means for controlling a traffic signal light unit using the selected traffic signal control parameter; and travel time acquiring means for acquiring travel time information about a vehicle within one or a plurality of road sections in a vicinity of the traffic signal light unit, wherein the storing means further stores a second pattern switching table in which a condition regarding a travel time in a second time zone T2 including only some of all the time zones of the whole day, and a traffic signal control parameter P2 selected when matching the condition are set in association with each other, wherein the traffic signal control system further comprises determining means for determining whether or not an index obtained on the basis of travel time information acquired by the travel time acquiring means matches the condition, and wherein the selecting means is configured to select the traffic signal control parameter P2 set in the second pattern switching table in place of the traffic signal control parameter P1(*i*) if the determining means determines that the index matches the condition.

2. The traffic signal control system according to claim 1, wherein an end time of the second time zone T2 is set as an end time of a first time zone B1(*k*) that is one of the first time zones included in the first time schedule, where k denotes any of integers 1 to m, a start time of the second time zone is set as a time later than a start time of the first time zone B1(*k*), and thereafter a traffic signal control parameter P2 that is set in association with the second time zone T2 in the second pattern switching table is set as a traffic signal control parameter P1(*k*+1) that is set in the first pattern switching table in association with a subsequent first time zone B1(*k*+1) that follows the first time zone B1(*k*) where if k=m, the (*k*+1) is set as (1).

3. The traffic signal control system according to claim 1, wherein a start time of the second time zone T2 is set as a start time of a first time zone B1(*k*) that is one of the first time zones included in the first time schedule, where k denotes any of integers 1 to m, an end time of the second time zone is set as a time earlier than an end time of the first time zone B1(*k*), and thereafter a traffic signal control parameter P2 that is set in association with the second time zone T2 in the second pattern switching table is set as a traffic signal control parameter P1(*k*−1) that is set in the first pattern switching table in association with a preceding first time zone B1(*k*−1) of the first time zone B1(*k*), where if k=1, the (*k*−1) is set as (m).

4. The traffic signal control system according to claim 1, wherein determination made by the determining means is performed every predetermined time in the second time zone T2, and, as a result of the determination, if the index does not match the condition, the selecting means selects a traffic signal control parameter that is set in the first pattern switching table so as to correspond to the time at which the determination is made.

5. The traffic signal control system according to claim 4, wherein the travel time acquiring means is configured to acquire a travel time on the basis of probe information that is travel locus information transmitted from a vehicle-mounted unit mounted in a plurality of public vehicles that follow a route including a point where the traffic signal light unit is installed, and wherein the predetermined time is set longer than a time interval during which the plurality of public vehicles pass through the point where the traffic signal light unit is installed.

6. A traffic signal control apparatus comprising:

storing means for storing a first pattern switching table in which a traffic signal control parameter P1(*i*) is set in association with each first time zone B1(*i*) of a first time schedule in which all time zones of a whole day is divided into a plurality of first time zones, where i denotes an integer of 1 to m and m denotes the number of time zones specified in the first pattern switching table;

selecting means for selecting a traffic signal control parameter corresponding to current time from the stored first pattern switching table;

controlling means for controlling a traffic signal light unit using the selected traffic signal control parameter; and travel time acquiring means for acquiring travel time information about a vehicle within one or a plurality of road sections in a vicinity of the traffic signal light unit, wherein the storing means further stores a second pattern switching table in which a condition regarding a travel time in a second time zone T2 including only some of all the time zones of the whole day, and a traffic signal control parameter P2 selected when matching the condition are set in association with each other, wherein the traffic signal control apparatus further comprises determining means for determining whether or not an index obtained on the basis of travel time information acquired by the travel time acquiring means matches the condition, and wherein the selecting means is configured to select the traffic signal control parameter P2 set in the second pattern switching table in place of the traffic signal control parameter P1(*i*) if the determining means determines that the index matches the condition.

7. A traffic signal control method comprising:

a storing step of storing a first pattern switching table in which a traffic signal control parameter P1(*i*) is set in association with each first time zone B1(*i*) of a first time schedule in which all time zones of a whole day is divided into a plurality of first time zones, where i denotes an integer of 1 to m and m denotes the number of time zones specified in the first pattern switching table;

a selecting step of selecting a traffic signal control parameter corresponding to a current time from the stored first pattern switching table;

a controlling step of controlling a traffic signal light unit using the selected traffic signal control parameter; and a travel time acquiring step of acquiring travel time information about a vehicle within one or a plurality of road sections in a vicinity of the traffic signal light unit, wherein the traffic signal control method further comprises a second storing step of storing a second pattern switching table in which a condition regarding a travel time in a second time zone T2 including only some of all the time zones of the whole day, and a traffic signal control parameter P2 selected when matching the condition are set in association with each other, and a determining step of determining whether or not an index obtained on the basis of travel time information acquired in the travel time acquiring step matches the condition, and wherein the selecting step is configured such that the traffic signal control parameter P2 set in the second pattern switching table is selected in place of the traffic signal control parameter P1(*i*) if it is determined in the determining step that the index matches the condition.

* * * * *